US006192593B1

(12) United States Patent
Borchers et al.

(10) Patent No.: US 6,192,593 B1
(45) Date of Patent: Feb. 27, 2001

(54) INTERNAL SHOE SIZING APPARATUS AND METHOD FOR SIZING SHOES

(75) Inventors: Bob Borchers, Coppell, TX (US); Chris Edington, Haeundae-Ku (KR); Michael Hailey, Seattle, WA (US); Bruce Kilgore, Lake Oswego; Lynn O'Mohundo, Wilsonville, both of OR (US)

(73) Assignee: Nike International Ltd., Beaverton, OR (US)

( * ) Notice: Subject to any disclaimer, the term of this patent is extended or adjusted under 35 U.S.C. 154(b) by 0 days.

(21) Appl. No.: 09/145,519

(22) Filed: Sep. 2, 1998

(51) Int. Cl.[7] ..... A43D 1/02

(52) U.S. Cl. ..... 33/3 A; 33/809; 33/542.1; 33/DIG. 2; 33/542; 324/716; 324/723

(58) Field of Search ..... 33/515, 3 R, 552, 33/546, 3 A, 3 B, 3 C, 542, 544.5, 542.1, 512, DIG. 2, 783, 809, 810, 811; 324/716, 723

(56) References Cited

U.S. PATENT DOCUMENTS

| | | | | |
|---|---|---|---|---|
| 309,666 | * | 12/1884 | Traver | 33/512 |
| 442,192 | * | 12/1890 | Lewis | 33/512 |
| 2,672,688 | * | 3/1954 | Crandall et al. | 33/3 A |
| 2,793,439 | | 5/1957 | Simpson | 33/3 |
| 3,098,301 | | 7/1963 | Simpson | 33/3 |
| 3,120,057 | | 2/1964 | Ludwig | 33/3 |
| 3,332,151 | * | 7/1967 | Gressley | 33/3 A |
| 3,359,640 | * | 12/1967 | Kirkland | 33/3 A |
| 3,579,837 | * | 5/1971 | Soriano | 33/3 |
| 3,757,418 | * | 9/1973 | Stiebel | 33/3 C |
| 4,604,807 | | 8/1986 | Bock et al. | 33/3 |
| 5,060,393 | * | 10/1991 | Silverman et al. | 33/512 |
| 5,128,880 | | 7/1992 | White | 364/550 |
| 5,164,793 | | 11/1992 | Wolfersberger et al. | 356/376 |
| 5,237,520 | | 8/1993 | White | 364/560 |
| 5,640,779 | | 6/1997 | Rolloff et al. | 33/514.2 |
| 5,790,256 | | 8/1998 | Brown et al. | 356/376 |

FOREIGN PATENT DOCUMENTS

| | | | | |
|---|---|---|---|---|
| 289408 | * | 11/1988 | (JP) | 33/542 |
| 4075603 | * | 3/1992 | (JP) | 33/3 R |

* cited by examiner

*Primary Examiner*—Diego Gutierrez
*Assistant Examiner*—Maria Fernandez
(74) *Attorney, Agent, or Firm*—Banner & Witcoff, Ltd.

(57) ABSTRACT

There is disclosed an internal sizing apparatus comprising a pneumatically activated probe that moves axially within a shoe and non-destructively measures the interior dimensions of the shoe. A linear pneumatic actuator is mounted between a heel piece and a probe. A linear potentiometer is mounted above the actuator and also connects to the probe. The apparatus is inserted into a shoe with the heel piece seated against the interior heel portion of the shoe. A computer system controlling the actuator extends the probe linearly into the shoe until the probe contacts the toe portion of the shoe. The potentiometer then measures the linear distance traveled by the probe and thus determines the internal linear dimension of the shoe. Depending on the type of probe, three-dimensional internal measurements of the shoe can also be quantified.

34 Claims, 11 Drawing Sheets

FIG.2
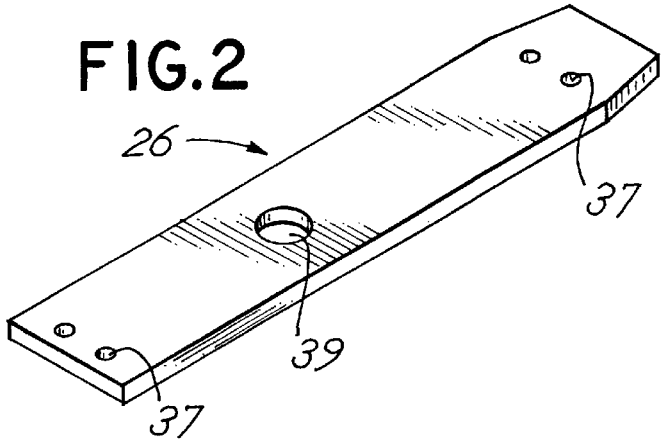
FIG.3
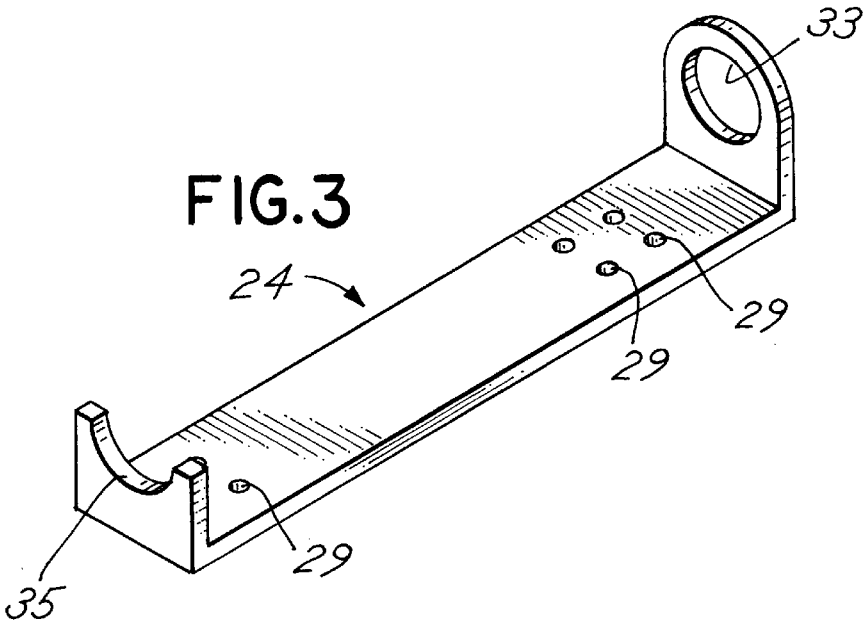
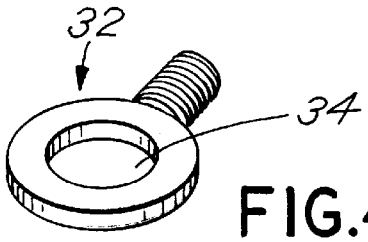
FIG.4

FIG.5
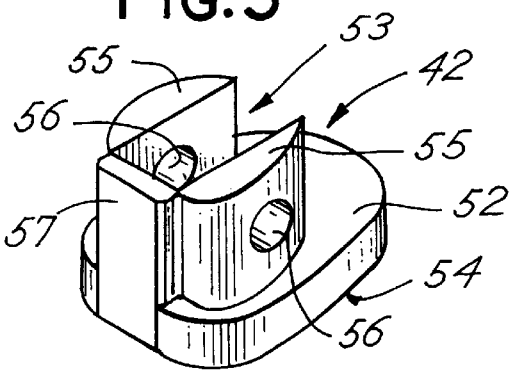
FIG.6
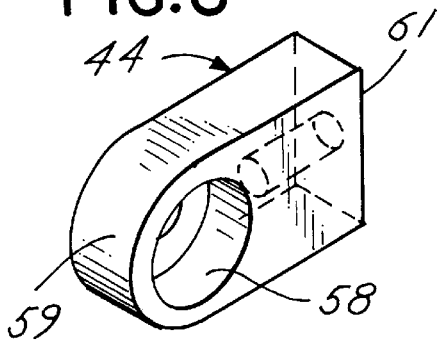
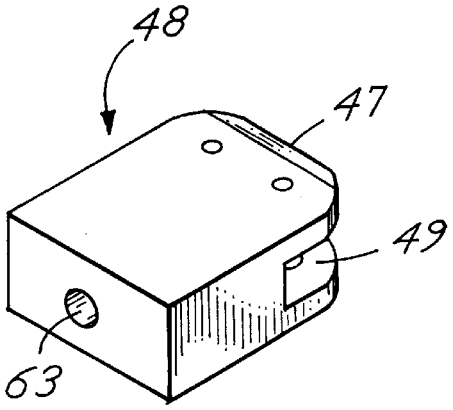
FIG.7
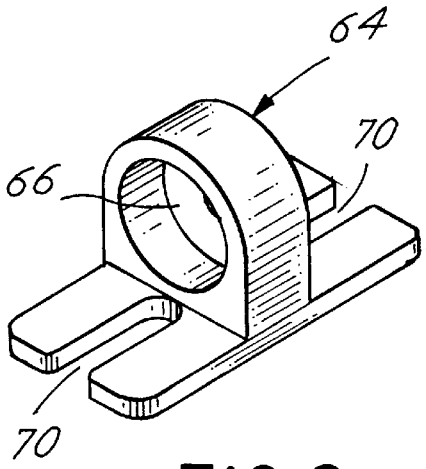
FIG.8

INTERNAL SHOE SIZING APPARATUS AND METHOD FOR SIZING SHOES

BACKGROUND OF THE INVENTION

1. Field of Invention

The present invention relates in general to shoe sizing. More specifically, but without restriction to the particular use which is shown and described, this invention relates to quantifying the interior dimensions and fit of a shoe.

2. Description of the Related Art

During the development and manufacturing of shoes, various production errors occur which result in shoes having inconsistent sizes and fits. Currently, for example, stick length inconsistencies are encountered during production. The stick length of a shoe is the internal linear measurement from the center of the heel to the center of the toe. It is common for shoe manufacturers to encounter large length inconsistencies for a given style and size shoe. These production errors are inherent in the way shoes are currently made.

Other errors inherent in shoe manufacturing arise from changes made to a shoe design during development and commercialization. For example, a shoe may be tested early in its design cycle and, using traditional fit testing methods, be found to fit well. As the design evolves, however, the elements of the shoe fit can be affected. Due to the pace of commercialization and the time consuming nature of traditional fit testing methods, the final shoe design may have different and unknown fit characteristics.

The present invention overcomes these problems by allowing shoe designers and developers to track the fit of a shoe during the design, development and production of the shoe. Changes in the internal dimensions of a shoe will alert the designer, developer and the factory to materials, process, or pattern discrepancies. These discrepancies, potentially cumulative, that are often found in the development and manufacture of shoes can be reduced if not eliminated by the present invention.

SUMMARY OF THE INVENTION

The present invention involves using a pneumatically activated probe that moves axially within a shoe and non-destructively measures the interior dimensions of the shoe. The probe is driven by a linear pneumatic actuator and the distance the probe travels within a shoe is measured by a linear potentiometer. The probe travel distance correlates to the internal linear dimension of the shoe measured from the heel to the toe (i.e., the stick length). Various types and styles of probes may be used to measure the stick length of shoes having various shoe widths. The pneumatic actuator is controlled by a computer system that allows for fast, accurate and reproducible testing of the interior dimensions of the shoe.

Briefly, the present invention involves attaching a probe to the output shafts of a pneumatic actuator and a linear potentiometer. The linear potentiometer is mounted above the actuator and the actuator is connected to a heel piece. The device is inserted into a shoe with the heel piece seated against the interior heel portion of the shoe. A computer system controlling the actuator extends the probe linearly into the shoe until the probe contacts the toe portion of the shoe. The potentiometer measures the linear displacement of the probe and thus determines the internal stick length of the shoe. Depending on the type of probe used, one can measure a variety of shoe fit parameters which include the stick length, forefoot width, length at a given width, and width at a given length. In addition, by attaching to the actuator and potentiometer a multi-axis probe having a plurality of pneumatically activated effectors spaced along the sides and across the top of the probe, one can measure the three-dimensional internal dimensions of the shoe. The computer controlled actuator retracts the probe to its original position and the testing may then be repeated.

Advantageously, the present invention allows for non-destructive testing of the interior dimensions of the shoe. Further, different fit conditions can be tested by varying the actuation pressure on the probe or, if the multi-axis probe is used, on the plurality of effectors extending out from the probe. In addition, a wide range of styles and sizes of shoes (men's and women's) can all be measured with the same instrument.

Various applications are envisioned with the present invention. A first application would occur during the development and commercialization of each shoe model. It is during these stages of the shoe development process that the present invention would play the important role of "tracking" the internal dimensions of the shoe.

For a given model, shoe development is an iterative process that involves many changes in materials, patterns, and even general design. At each step along the development process, shoe samples are produced that are evaluated both visually and, if there is adequate time, through fit testing. On occasion, changes in the shoe during the development process result in shoe samples that are not the same "fit" as their predecessors. Many times this change in a shoe fit is intentional. However, in the situation where a predecessor shoe fits well, it is very important that future changes in materials, patterns or even general design, do not negatively affect this fit. In a method of use, the present invention thus tracks the internal dimensions of all the sample shoes made. Drastic changes in internal dimensions from one sample to its next iteration will alert the shoe developer of the extent to which a given change has affected the fit of that particular model. Once a model's sample has been found to fit as desired, the internal dimensions measurement for that sample will serve as the standard against which subsequent samples, and even the eventual production shoes, are compared.

The primary improvement this method provides is the inclusion of an objective measurement device into the development and commercialization process. No longer would the shoe samples be evaluated solely on aesthetics or a subjective fit test. Moreover, the inclusion of this method will help to indicate the effect of various changes upon the internal dimensions of the shoe, and hence, their effect upon the fit of that shoe. Finally, once a good fit has been identified, knowledge of that internal dimensions measurement will help to ensure that subsequent samples and production shoes will consistently fit well.

A second application would be in a factory setting where the present invention would play an important role in measuring the fit consistency of a given shoe model during production of the shoe. Many shoes are produced in large volume, requiring multiple production sources and multiple production periods. In order to ensure the consistency of a given model that is produced in multiple factories in multiple countries over many months, the present invention can be utilized to measure various production samples made at each source throughout the production duration.

As discussed above, an internal dimensions specification or shoe standard, attained through the use of the present invention, will be determined for each shoe model. For multiple-sourced models, this specification is sent out to each of the factories that are to produce the shoe. The present invention would then be used to measure the internal dimensions of the shoe models at each factory and compare with the standard for that model. Drastic changes in the internal dimensions of these samples, as compared with the standard, will alert the developer and the factory to materials, process, or pattern discrepancies that need to be identified and eliminated before full-scale production may begin. The production method would also call for the measurement of a random sampling of each source's product at intervals throughout the production cycle on a given model. This sampling should ensure that a consistent product is produced at every source throughout the duration of the production process.

Additionally, with the present invention available to the factories, measurements could be taken on the internal dimensions of all shoes as they come down the production line, allowing for very quick discovery of potential problems regarding the consistency of fit for shoes produced on a given day, or even on a given shift. If correction of the production problems is too complex, the present invention could alternatively be used to size finished products. That is, as shoes are finished they could be measured with the present invention and labeled appropriately. For example, even if a shoe was intended to be a size 10, if it measures like a shoe size 9, it would be labeled and sold as a size 9. Using the present invention in this manner, shoe sizing and fit consistency would be ensured even after production.

Again, the primary improvement this method of use for the present invention provides is the inclusion of an objective measurement device into the shoe production process in an effort to maintain consistency in production. Traditionally, once shoe specifications have been sent out to the various sources, there has been no objective means to ensure that shoes produced at multiple sources fit consistently regardless of the source. Similarly, there has not been any means to ensure that shoes are produced consistently throughout the production period within a single factory. Now, with the present invention, shoe fit consistency can be maintained regardless of the source factory.

A third envisioned application for the present invention would be in a retail setting where it is often very difficult to define what a good shoe fit is for a given person. In this case, a customer could bring in the shoes that define a perfect fit for them and the present invention could be used to quantify the particular fit of those shoes. Comparing the old shoe dimensions to a database of dimensions on current shoe products would allow for quick and accurate identification of the best fitting products.

As conventional, most shoe purchases are conducted by measuring the consumer's foot on a Brannock Device and matching that reading with the numbers sewn on the tongue of the shoe. Production inconsistency, however, limits the accuracy and effectiveness of the values inscribed on the shoes themselves. In a method of use in a retail environment, the present invention would measure the internal dimensions of the customer's old comfortable shoes. The measured values, for the left and right shoes, are then compared to those values attributed to a corresponding product size and thus a properly fitting shoe is selected.

Advantageously, having a customer know his or her internal dimensions preference will be invaluable in the non-interactive retail environments involving purchases over the Internet or through catalogues. Moreover, this method of use in a retail environment would be most effective upon the successful implementation of the development/commercialization and production methods that ensure a consistent product, whatever the model or source. Nevertheless, in the event that total production consistency is not yet fully reliable, the customer's internal dimension preference, as measured by the present invention, can be compared with those shoes obtained from the retail stock.

Like the other methods of use for the present invention, this method provides the inclusion of an objective measurement device into the retail environment. Traditionally, upon measuring a customer's feet, the sales person would hope that production variation would be small enough to allow him to reasonably fit the customer after one or two attempts. With the present invention, the customer would no longer have to try on several shoes to obtain the desired fit. The envisioned method of use in the retail environment coupled with the other two methods described above, would ensure a "guaranteed" shoe fit for a consumer.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWINGS

The preferred embodiment of the invention will be described in relation to the accompanying drawings. In the drawings, the following figures have the following general nature:

FIG. 2 is an isometric view of the potentiometer top mount of the invention of FIG. 1.

FIG. 3 is an isometric view of the potentiometer bottom mount of the invention of FIG. 1.

FIG. 4 is an isometric view of the heel harness guide of the invention of FIG. 1.

FIG. 5 is an isometric view of the quick release joint piece of the invention of FIG. 1.

FIG. 6 is an isometric view of the stick length joint piece of the invention of FIG. 1.

FIG. 7 is an isometric view of the end piece of the invention of FIG. 1.

FIG. 8 is an isometric view of the forefoot joint piece of the invention of FIG. 1.

DESCRIPTION OF THE PREFERRED EMBODIMENTS

Figure 1:
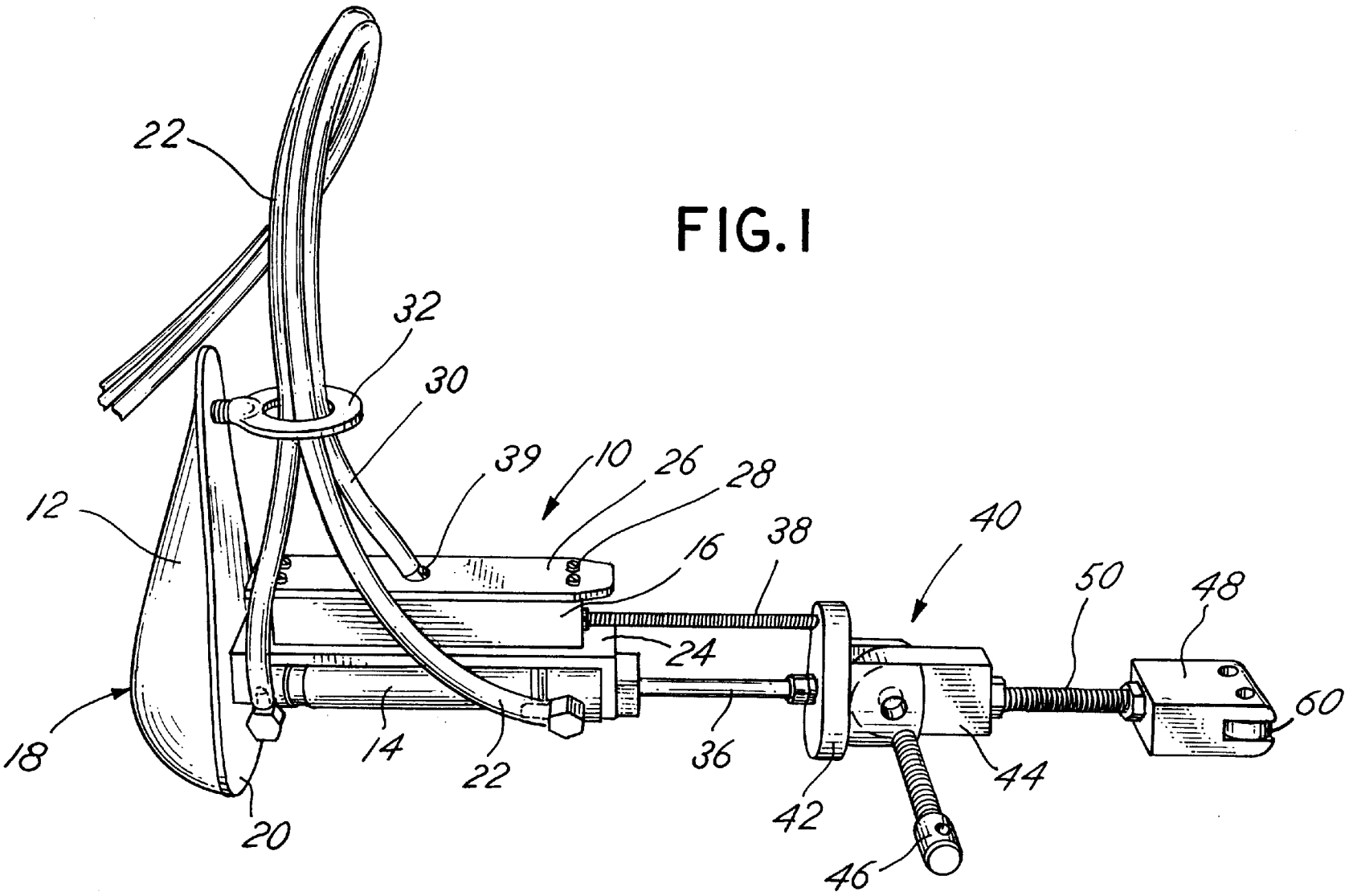
FIG. 1 is an assembled view of the shoe sizing apparatus of the present invention.

Referring to the drawings wherein like numerals indicate like elements, there is shown in FIG. 1 an internal shoe size device 10 in accordance with the present invention. The internal shoe size device 10 measures the internal length of the shoe (stick length) from the heel to the toe, along a single axis of actuation. The shoe size device 10 includes a proximal end 12, a pneumatic actuator 14, and a measuring device 16.

Figure 13:
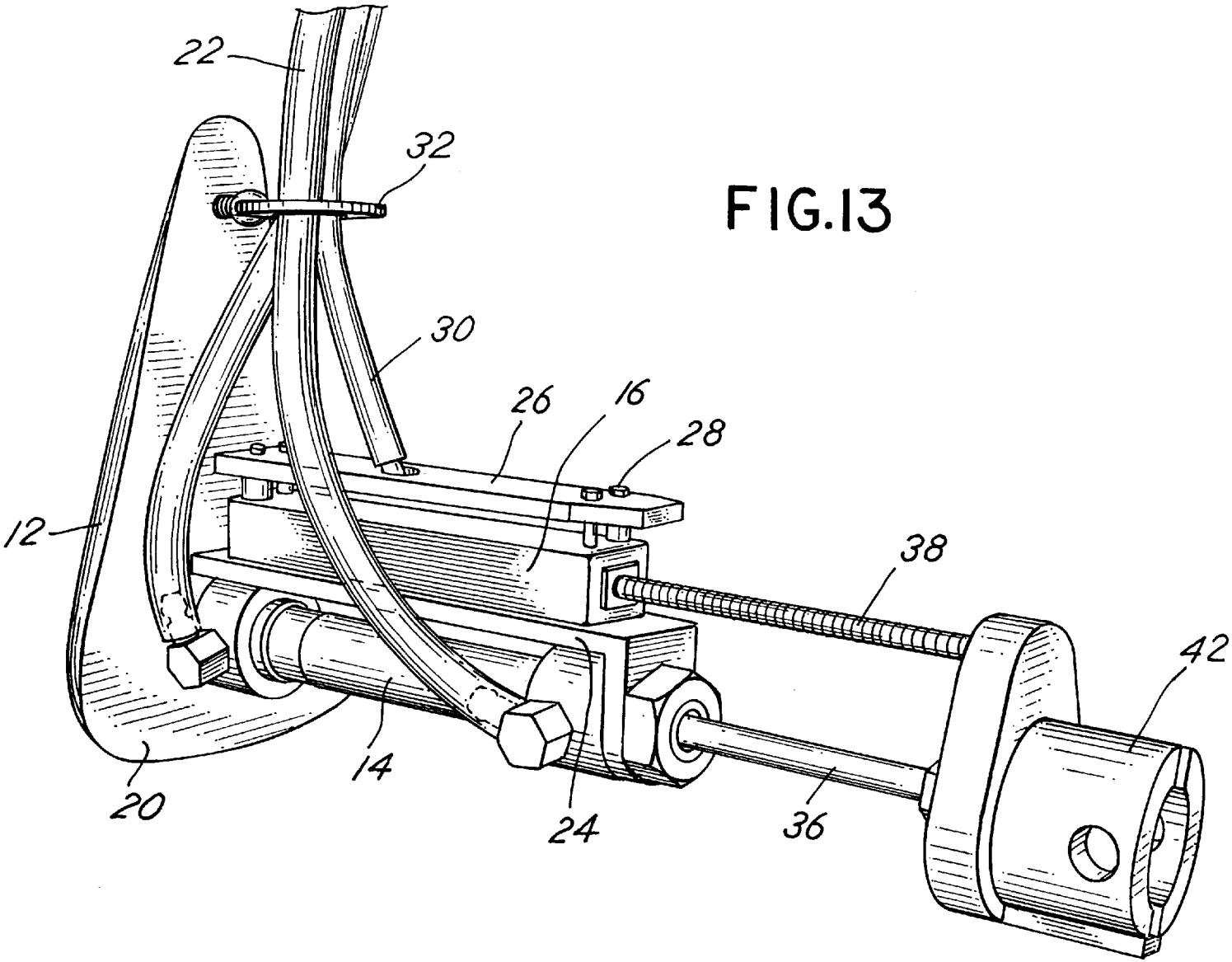
FIG. 13 is an assembled isometric view of the invention of FIG. 1.
Figure 17:
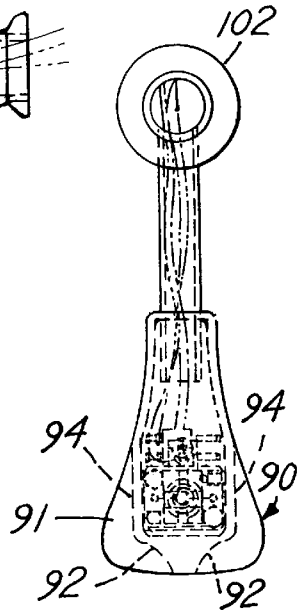
FIG. 17 is an end elevation view of an alternative embodiment of the proximal end of the invention of FIG. 1.
Figure 16:
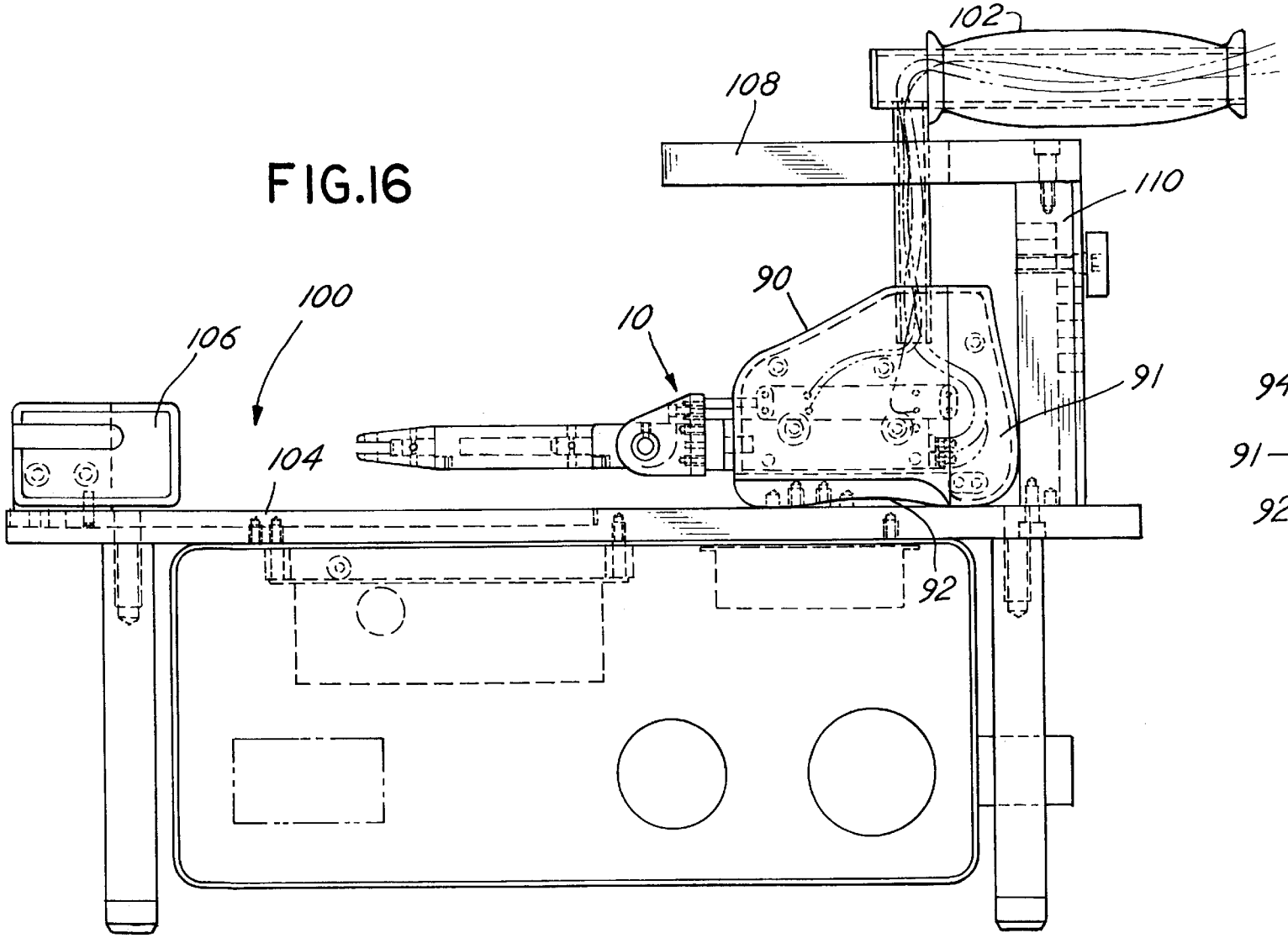
FIG. 16 is a side elevation view of a shoe test fixture of the invention of FIG. 1.

Referring to FIGS. 1 and 13, the proximal end 12, or commonly referred to as a heel piece, is depicted and defines a curved surface 18 that matches the shape of the internal heel portion of a shoe. The curved surface 18 is based off an average foot shape and is symmetric so as to be used in both left and right shoes. Further, the curved surface 18 does not change based upon size or gender of the product. The curved surface 18 of the heel piece 12 allows the heel piece 12 to center itself within the heel of the shoe for accurate and consistent shoe size readings. The heel piece 12 also has a flat surface 20 with a generally oval shape configuration for mounting the pneumatic actuator 14 to the heel piece 12. Referring to FIGS. 16 and 17, an alternative embodiment of the proximal end of the shoe sizing device is illustrated. Proximal end 90 defines a curved surface 91 that matches the shape of the internal heel portion of a shoe. In addition, the proximal end 90 defines a pair of curved underside surfaces 92 that match the shape of the internal arch portion of a shoe and parallel side walls 94 which enclose the pneumatic actuator 14 and the measuring device 16. As shown in FIG. 17, the curved underside surface 92 is located on opposing sides of the shoe size device 10 so that the device 10 can be used with either a right or left shoe. The curved underside 92 enhances the positioning and seating of the shoe sizing device in the shoe.

Referring back to FIGS. 1 and 13, the pneumatic actuator 14 is removably connected to the flat surface 20 of the heel piece 12 and centered laterally on the oval shaped flat surface 20 near the bottom of the flat surface 20. The mounted pneumatic actuator 14 extends in a substantially perpendicular direction to the plane formed by the flat surface 20. The pneumatic actuator 14 is preferably a linear pneumatic actuator having a solid output shaft 36 that extends and retracts from its cylindrical housing depending on the direction and pressure of air flow through the actuator. Other types of actuators are contemplated and considered within the scope of the invention. Attached to the pneumatic actuator 14 are pneumatic hoses 22 within which pressurized air controls the action of the actuator.

As exemplified in FIG. 1, the measuring device 16 is typically a potentiometer mounted above the pneumatic actuator by a mount assembly consisting of a bottom mount 24 and a top mount 26. Other measuring devices may be used and are considered to be within the scope of the present invention. The bottom mount 24 seats over the pneumatic actuator 14 while the top mount 26 is positioned over the potentiometer 16. Fasteners 28 fixedly hold the top mount 26 to the bottom mount 24 and thus fix the potentiometer 16 to the bottom mount.

Referring to FIG. 3, the bottom mount 24 is illustrated and has a plurality of sets of holes 29 to receive the fasteners 28. The plurality of sets of holes 29 allows for the longitudinal positioning of the potentiometer 16 along the bottom mount 24 depending on the desired potentiometer 16 location. Hole 33 is located on one end of the bottom mount 24 and is sized to allow the pneumatic actuator 14 to pass through and mount to the heel piece 12. Located at the opposite end of the bottom mount 24, is a U-shaped bracket 35 that seats on the cylindrical housing of the pneumatic actuator 14.

Referring to FIG. 2, the top mount 26 is illustrated and has a pair of sets of holes 37 for receiving fasteners 28. Hole 39 is located near the center of the top mount 26 and is sized to allow an electric cord 30 of the potentiometer 16 to pass through.

Referring back to FIG. 1, attached to the potentiometer 16 is the electric cord 30 containing electric wires that relay electrical signals from the potentiometer 16 to a signal receiving device, not shown. The potentiometer 16 includes an extending and retracting output shaft 38 that is spring biased. Referring to FIGS. 1 and 4, a heel harness guide 32 is threadably mounted to the flat surface 20 of the heel piece 12 and defines an eyelet 34. The size of the eyelet 34 is determined by the sizes of the pneumatic hoses 22 and the electric cord 30. The eyelet 34 must have a sufficient opening to allow the pneumatic hoses 22 and electric cord 30 to pass through but also be small enough to hold the hoses 22 and cord 30 in place without excessive movement.

Attached to both the output shaft 36 of the pneumatic actuator 14 and the threaded output shaft 38 of the potentiometer 16 is a probe 40. The probe 40 may consist of numerous components and have various shapes and configurations. The present invention recognizes that any number and types of probes 40 can be easily attached to the pneumatic actuator 14 and potentiometer 16 and still be considered within the scope of the invention. As exemplified in FIG. 1, one embodiment of the probe 40 of the present invention comprises a quick release joint piece 42, a stick length joint piece 44, a quick release pin 46, a stick length end piece 48 and a steel shaft 50.

Referring to FIGS. 1 and 5, the quick release joint piece 42 defines a circular disk 52 having on one side a flat surface 54 whereon the threaded output shaft 38 and output shaft 36 are removably connected. The quick release joint piece 42 is attached to output shafts 36 and 38 such that the plane formed by the flat surface 54 is substantially perpendicular to the output shafts 36 and 38. The quick release joint piece 42 also defines a pair of parallel walls 55 integral with and extending out from the circular disk 52. A gap or opening 53 is formed between the parallel walls 55 and is sized to receive the stick length joint piece 44. Within each of the parallel walls 55 is a pair of holes 56 that are in concentric alignment with each other. The holes 56 receive the quick release pin 46 which removably connects the quick release joint piece 42 to the stick length joint piece 44. Connected and adjacent to the parallel walls 55 is an end wall 57 that provides strength and support to the parallel walls 55. The end wall 57 also extends out perpendicular from the circular disk 52.

Referring to FIGS. 1 and 6, the stick length joint piece 44 defines a rectangular block with a rounded end having a predetermined thickness to removably fit within the opening 53 formed between the parallel walls 55. A hole 58 through the joint piece 44 is laterally centered and is located near the end 59 of the joint piece 44. As above, the stick length joint piece 44 is releasably connected to the quick release joint piece 42 by the quick release pin 46. In operation, the hole 58 of the stick length joint piece 44 is aligned with the pair of holes 56 of the quick length joint piece 42. The quick release pin 46 is inserted through the aligned holes 56 and 58, thereby connecting the stick length joint piece 44 to the quick release joint piece 42. The resulting connection provides a pivoting connection between the stick length joint piece 44 and the quick release joint piece 42 about the quick release pin 46. Removably attached to the end 61 of the stick length joint piece 44 is the steel shaft 50.

The steel shaft 50 is a solid cylindrical shaft having a predetermined length. Depending on the desired shoe size range to be measured, one can select from a variety of shaft lengths. That is, based off the displacement range of the pneumatic actuator 14, a single length of shaft 50 can be used to measure a number of shoe sizes, for example, men's sizes 8–10.

Referring to FIGS. 1 and 7, removably attached to the steel shaft 50, opposite the stick length joint piece 44, is the stick length end piece 48 or alternatively, an end effector. Each end effector or end piece 48 is designed with a specific measurement in mind. For example, when measuring the stick length of the shoe, the end piece 48, as exemplified in FIG. 7, is preferred. The end piece 48 is small enough to fit into the very end or toe portion of a variety of shoes. The end piece 48 at end 47 has rounded corners and defines a slot 49 to receive two edge bearings 60 that sense the toe of the shoe and facilitate the accurate and repeatable location of the center of the toe. Two edge bearings 60 are preferred for consistent, accurate and repeatable sensing of the toe, thereby resulting in accurate stick length measurements. The end piece 48 also defines an opening 63 to receive the steel shaft 50 so as to removably attach the end piece 48 to the steel shaft 50. Other end pieces 48 and other numbers and types of bearings 60 may be used to accurately sense the center of the toe and are thus considered within the scope of the present invention.

Figure 9:
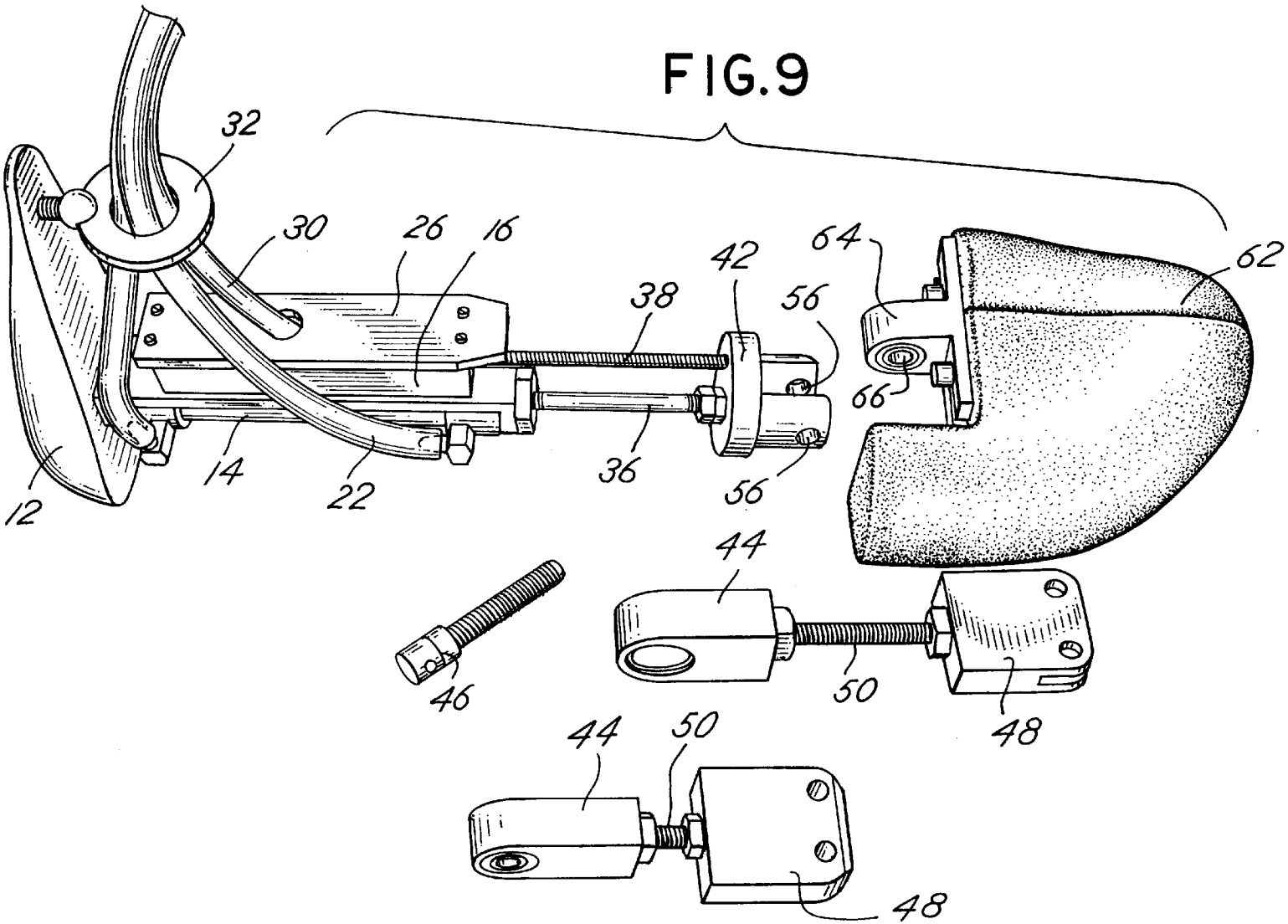
FIG. 9 is an isometric view of an alternative embodiment of the end piece of the invention of FIG. 1.

Referring to FIG. 9, an alternative embodiment of the end piece 48 of the present invention is disclosed that is designed to measure the length of the shoe at a given width. End piece 62 is illustrated as a one-piece effector and is shaped to more closely mimic the way a human foot would fit into a shoe. Referring to FIGS. 8 and 9, end piece 62 is fastened to a forefoot joint piece 64 having a hole 66. The end piece 62 is removably mounted to the quick release joint piece 42 by aligning the hole 66 of the forefoot joint piece 64 with holes 56 of the quick release joint piece 42 and inserting the quick release pin 46.

Figure 10:
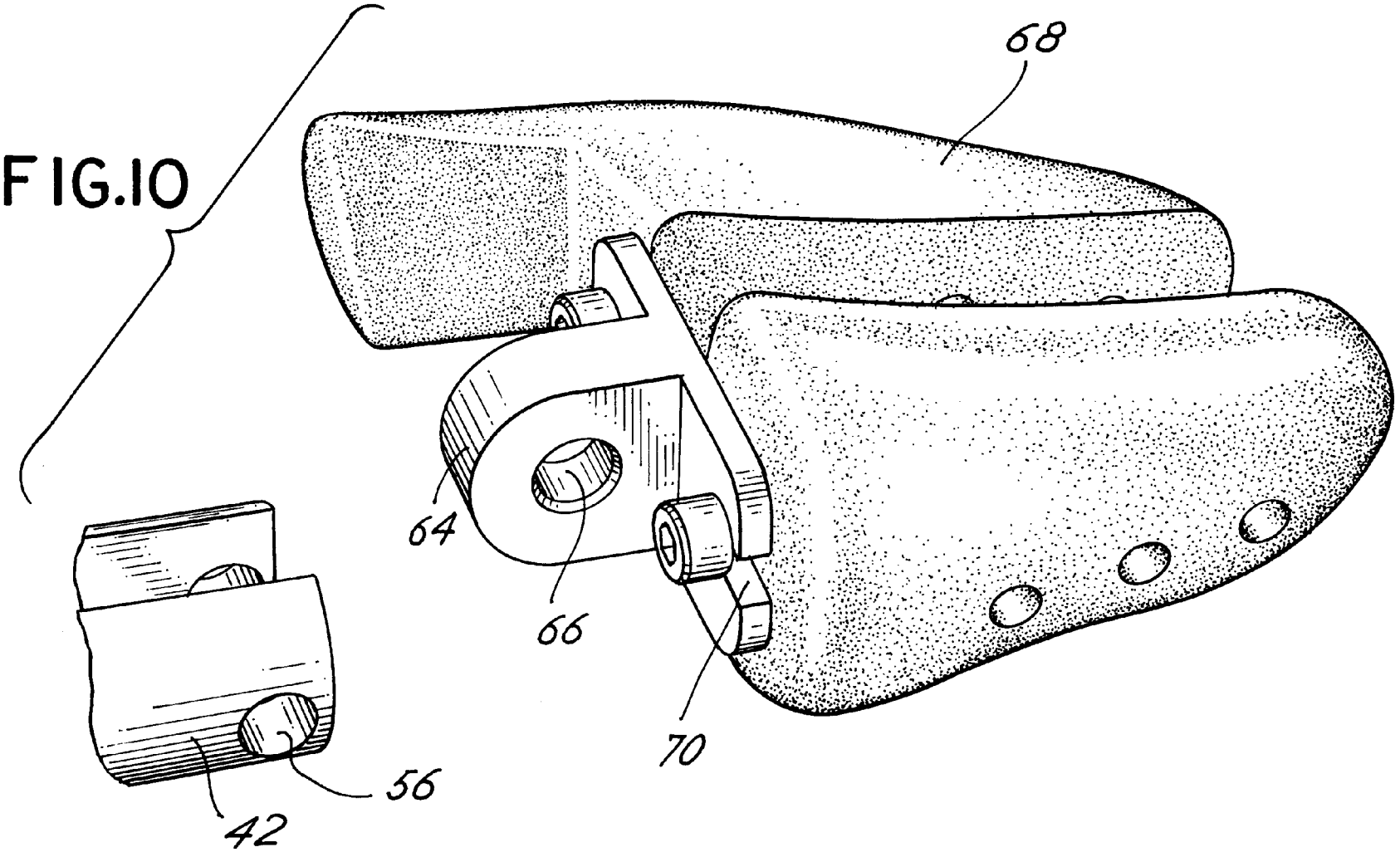
FIG. 10 is an isometric view of an alternative embodiment of the end piece of the invention of FIG. 1.

Referring to FIG. 10, still another embodiment of the end piece 48 is illustrated. End piece 68 is shown as a split-toe effector. The shape of the end piece 68 is based off an average foot shape and incorporates a mechanism for varying the width. Instead of a one-piece effector, the end piece is split down the center creating two pieces. Each piece is fastened to slots 70 in the forefoot joint piece 64, as shown in FIG. 8. The slots 70 permit the re-positioning of the two pieces of the end piece 68, thereby allowing the width of the end piece 68 to vary. Advantageously, the lateral distance between the two pieces of the end piece 68 can be changed thus permitting change in the overall width of the end piece 68 to accommodate various shoe size widths (from a very narrow AA foot width to a wide EEE foot width).

Figure 11:
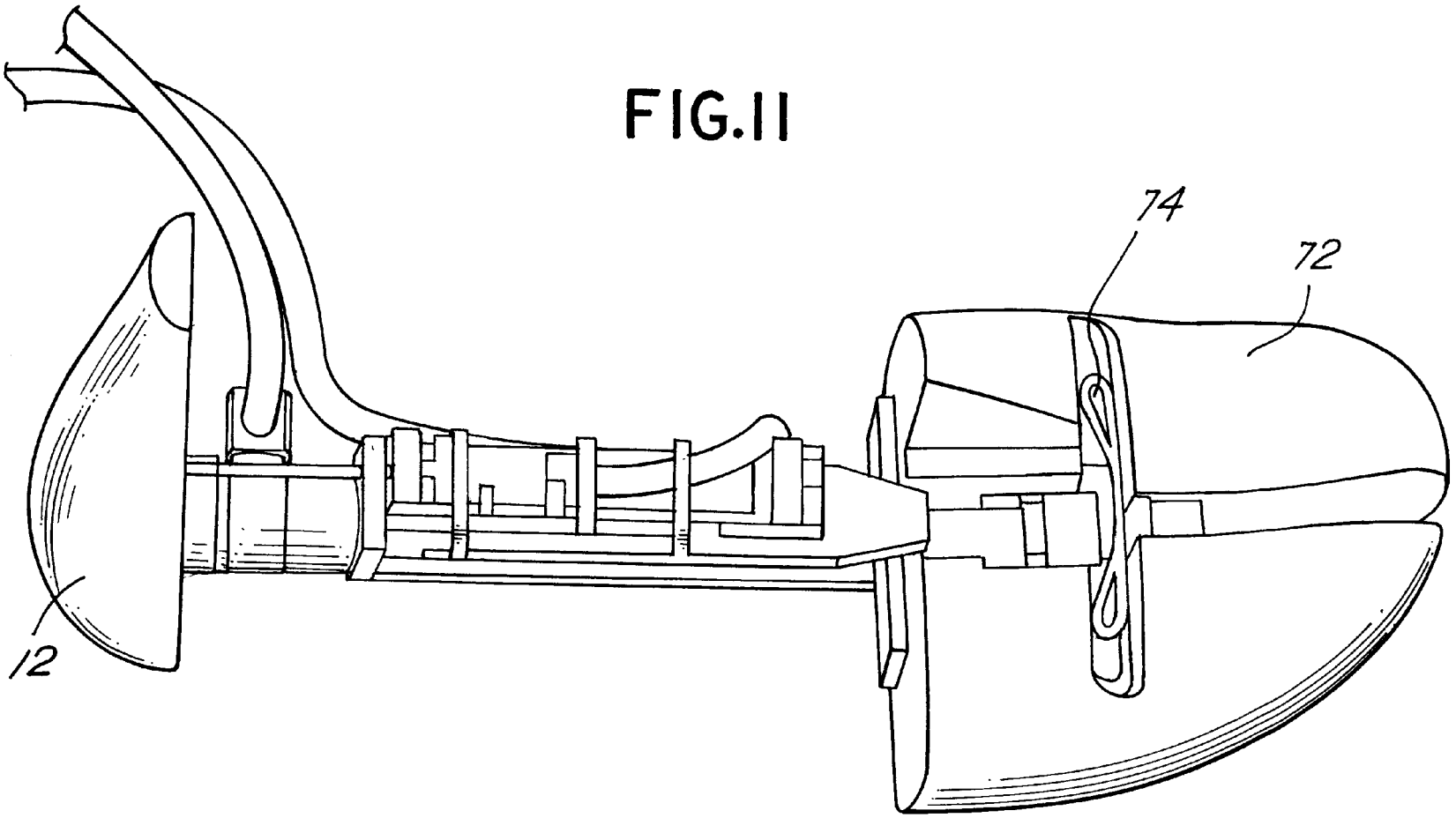
FIG. 11 is an isometric view of an alternative embodiment of the end piece of the invention of FIG. 1.
Figure 12:
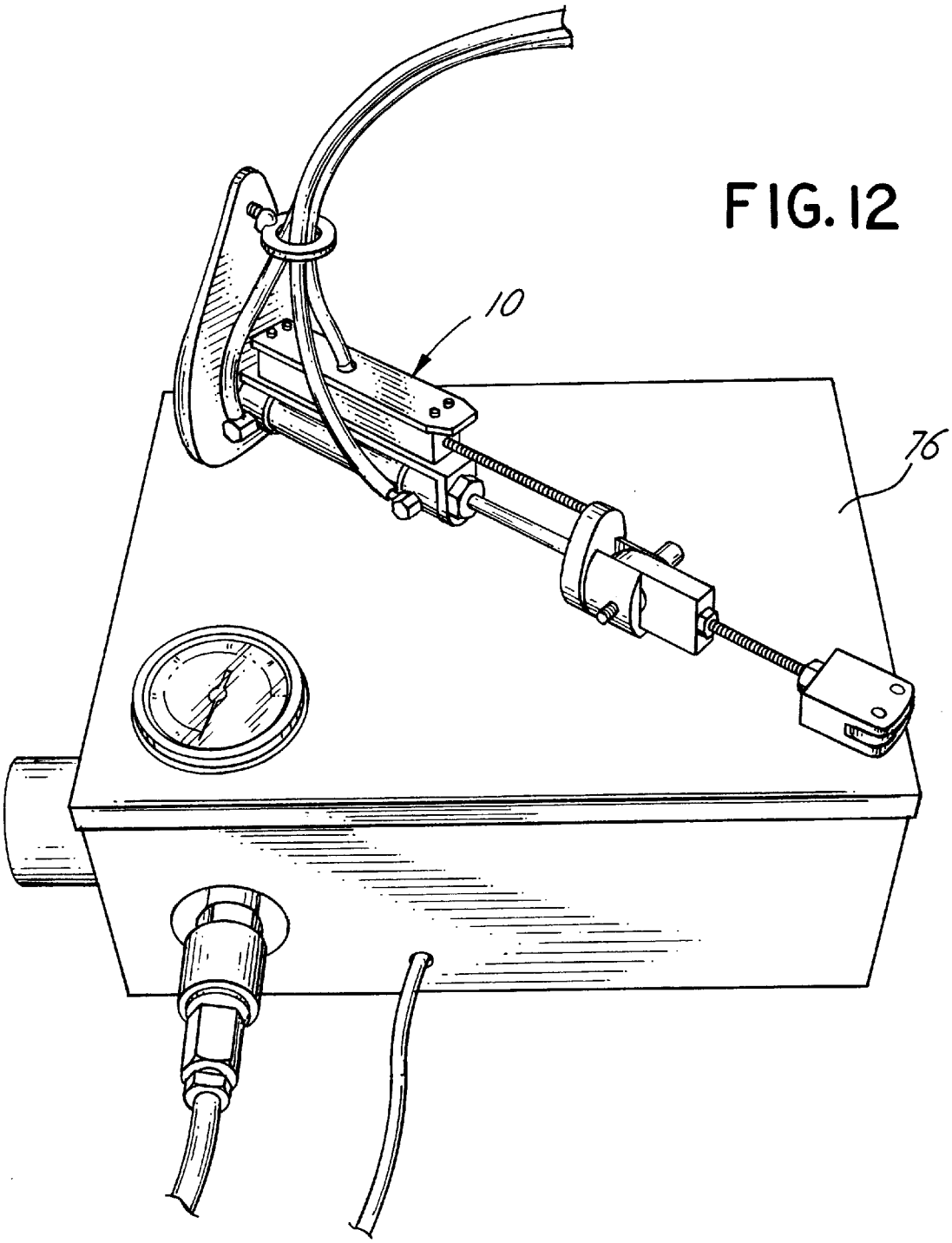
FIG. 12 is an isometric view of the computer system assembled to the shoe sizing apparatus of the present invention.

Referring to FIG. 11, yet another embodiment of the end piece 48 is illustrated. End piece 72 is also shown as split-toe effector. Again, the shape of the end piece 72 is based off an average foot shape and incorporates a mechanism for varying the width. In this embodiment, the two pieces of the end piece 72 are connected by a screw and shaft assembly 74 that is capable of continuously changing the distance between the two pieces and thus the overall width of the end piece 72. Again, end piece 72 can accommodate shoe size widths from a narrow AA to a wide EEE foot width.

Figure 14:
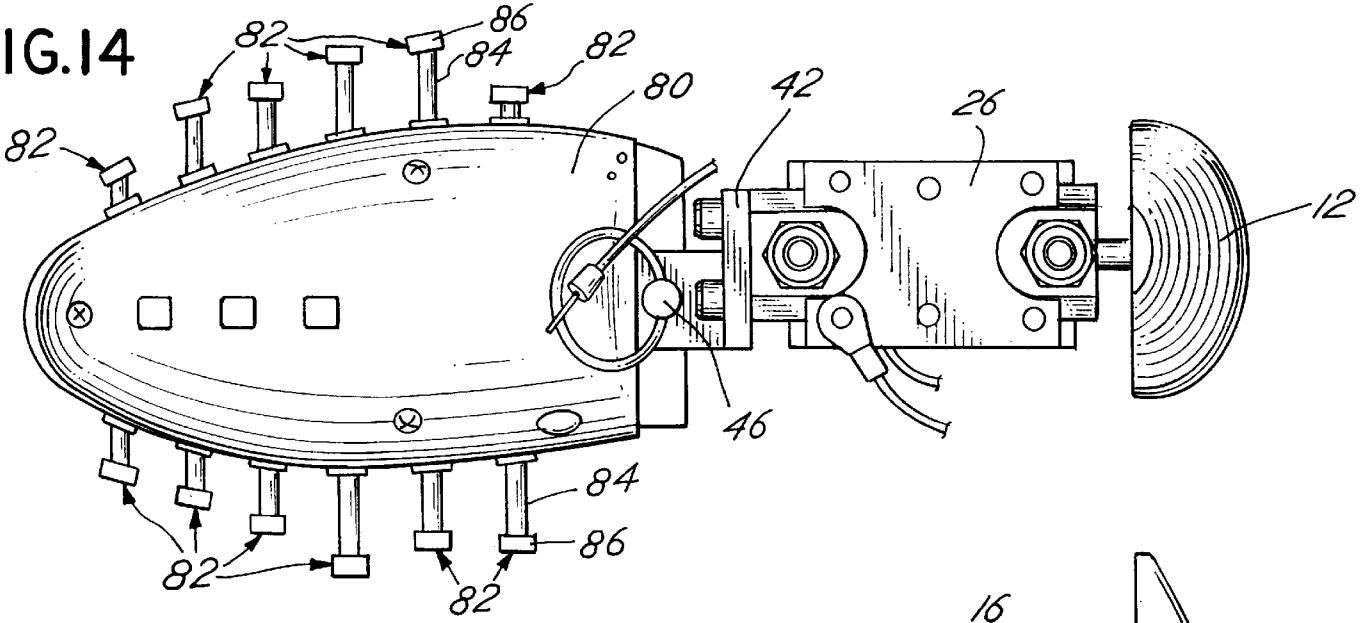
FIG. 14 is a top plan view of an alternative embodiment of the end piece of the invention of FIG. 1.
Figure 15:
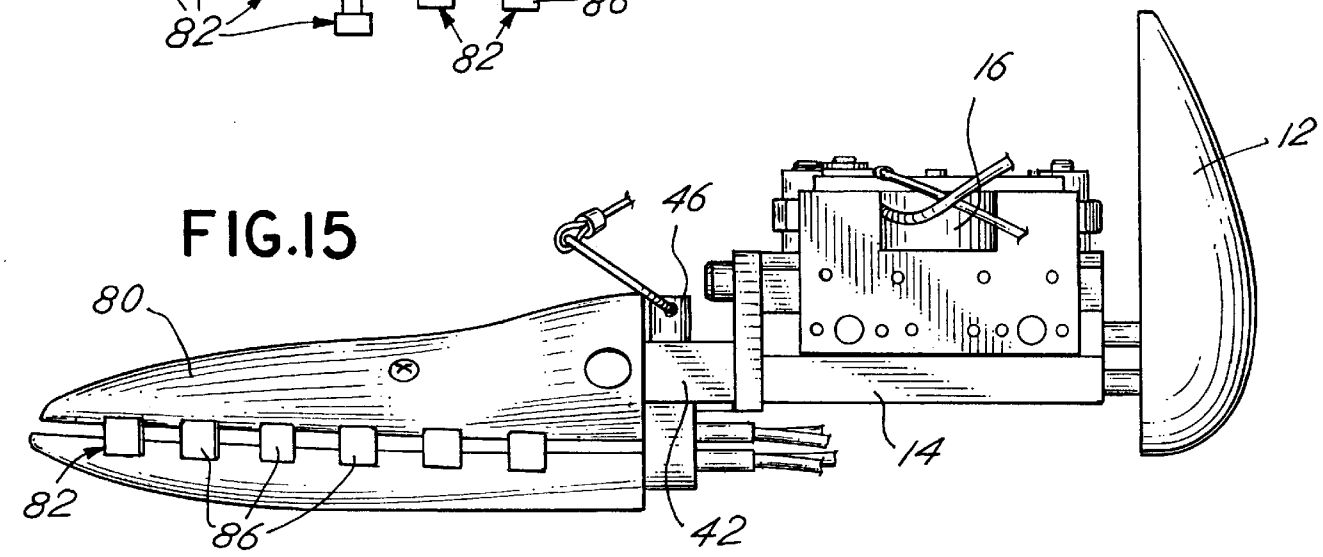
FIG. 15 is a side elevation view of an alternative embodiment of the end piece of the invention of FIG. 1.

Referring to FIGS. 14 and 15, still another embodiment of the end piece 48 is depicted. End piece 80 is a one-piece multi-axis device having a shape that is based off an average foot shape. A plurality of spaced apart plungers 82 or effectors extend out from the sides and across the top of the end piece 80. In particular, six pairs of effectors are located along the sides of the end piece 80 and three effectors are positioned along the top. These effectors 82, preferably steel shafts 84 having a square head piece 86 attached to the end of the shafts, extend outward from the end piece 80 to contact the interior side walls and toebox of the shoe. The displacement of each effector 82 is measured by a potentiometer and the resulting data allows one to describe the pseudo-surface in the forefoot. The resulting data from the six pairs of horizontal effectors, the three vertical effectors, the bottom surface of the end piece 80, and the point of contact of the end piece 80 to the toe of the shoe creates a quantifiable three-dimensional internal layout of the shoe. Similar to the mounting arrangements of the other embodiments of the end piece 48, end piece 80 is mounted to the pneumatic actuator 14 and potentiometer 16 via the quick release joint piece 42.

Figure 18:
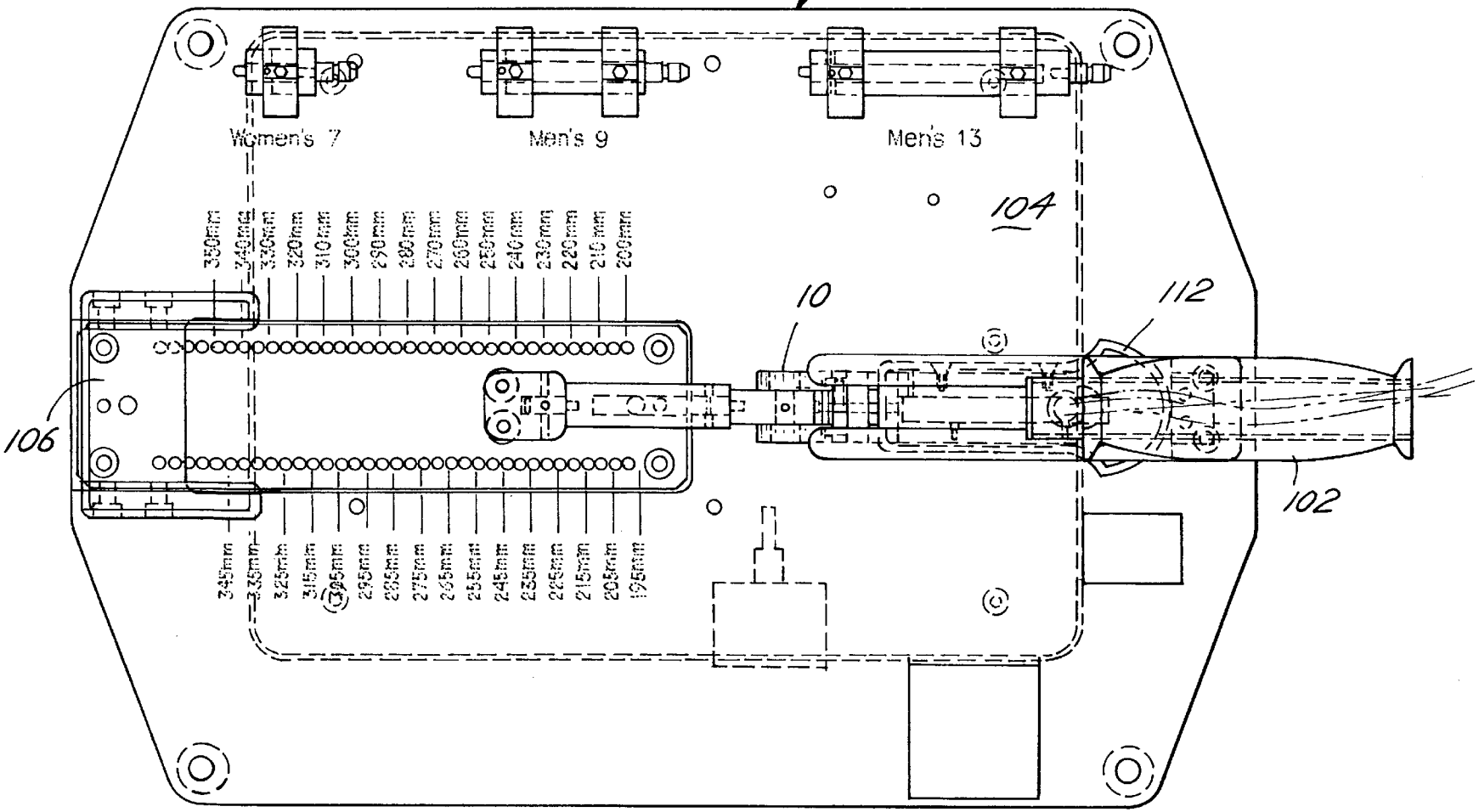
FIG. 18 is a top plan view of the shoe test fixture of FIG. 16.

Referring to FIGS. 16–18, a shoe test fixture 100 is exemplified that prevents the shoe size device 10 and the shoe, not shown, from tipping onto its side during testing. Also illustrated is a shoe sizing apparatus support handle 102 connected to the proximal end 90 of the shoe size device 10. The shoe test fixture 100 includes a fixture plate 104, a toe piece 106, and a handle support bracket 108 supported by a vertical plate 110. The toe piece 106 is preferably a U-shaped block that may be adjustably moved in a linear direction on the fixture plate 104 depending on the external length of the shoe. The U-shape of the toe piece 106 provides a recess to receive the toe of a shoe and prevent lateral and longitudinal movement during testing. Other shapes of the toe piece 106 or other means of fixing the toe of the shoe to the plate 104 are contemplated and considered within the scope of the present invention. The handle support bracket 108 defines a notch 112 wherein the support handle 102 seats, thereby maintaining the shoe size device 10 in an upright position.

When testing a shoe, the shoe is placed on the fixture plate 104 and fixed between the vertical plate 110 and the toe piece 106, thereby preventing movement of the shoe during testing. The shoe size device 10 is then inserted into the shoe with the proximal end 90 abutting the internal heel portion of the shoe. The support handle 102 seats within the notch 112 of the support bracket 108. The notch 112, in turn, holds the support handle 102 and accompanying shoe size device 10 in an upright position. Other test fixtures that maintain the shoe size device 10 in an upright position may be used and still be considered within the scope of the present invention.

In order to get reasonably accurate and repeatable results with the present invention, the sampling and measurement protocol is critical. A single measurement cycle (cycle= pneumatic actuator shaft 50 extends, the resulting displacement is measured by the linear potentiometer 16, and the actuator shaft 50 retracts to its original position) is not adequate. Rather, a series of loading and unloading cycles is necessary to achieve stick length results that vary by less than 1 millimeter in length. For example, the current protocol for the stick-length measurement includes approximately 50 cycles with the last 10 length measurements being averaged together to yield the final stick-length measurement. With such a protocol, the length of a given shoe can be repeatably measured to within approximately 0.33 millimeters. Based on testing within a frequency range of 0.2 to 1 Hz, measurements from the present invention appear to be independent of the loading frequency. Thus, the total measurement time for a single shoe, using the current protocol is less than 120 seconds. While the current protocol includes 50 cycles for stick-length measurements, adequate results can be obtained by cycling 3 or more times.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. An internal shoe sizing apparatus comprising:

a proximal end piece, an actuator mounted to the proximal end piece, a probe connected to the actuator, and a potentiometer for measuring the linear displacement of the probe and thus determining the internal length of a shoe, the potentiometer mounted adjacent to and in substantially parallel relation to the actuator and connected to the probe.

2. The internal sizing apparatus as in claim 1 wherein the probe comprises a quick release joint piece, a stick length joint piece removably connected to the quick release joint piece, a shaft removable mounted to the stick length joint piece, and a distal end piece removably mounted to the shaft.

3. The internal sizing apparatus as in claim 2 wherein a pin connects the quick release joint piece to the stick length joint piece.

4. The internal sizing apparatus as in claim 2 wherein the actuator and the measurement device are connected to the quick release joint piece.

5. The internal sizing apparatus as in claim 2 wherein the distal end piece is a solid rectangular shaped effector.

6. The internal sizing apparatus as in claim 2 wherein the distal end piece is a two-piece effector.

7. The internal sizing apparatus as in claim 2 wherein the distal end piece is a multi-axis effector, the multi-axis effector measuring the three-dimensional internal dimensions of a shoe.

8. The internal sizing apparatus as in claim 1 wherein the proximal end piece is shaped to match the contour of a heel.

9. An internal shoe sizing apparatus comprising:

a proximal end piece, an actuator connected to the proximal end piece, a probe connected to the actuator, the probe comprising a stick length joint piece and a distal end piece connected to the stick length joint piece by a shaft, and a measurement device for measuring the linear displacement of the probe and thus determining the internal length of a shoe, the measuring device mounted adjacent to and in substantially parallel relation to the actuator and connected to the probe.

10. The internal sizing apparatus as in claim 9 wherein the probe further comprises a quick release joint piece and a pin, the pin removably connecting the quick release joint piece to the stick length joint piece.

11. The internal sizing apparatus as in claim 9 wherein the measurement device is a potentiometer, the actuator and the potentiometer being connected to the quick release joint piece.

12. The internal sizing apparatus as in claim 11 further comprising a potentiometer mount for mounting the potentiometer to the actuator, the potentiometer mount defining a bottom mount plate and a top mount plate.

13. The internal sizing apparatus as in claim 9 wherein the distal end piece is a solid rectangular shaped effector.

14. The internal sizing apparatus as in claim 9 wherein the distal end piece is a two-piece effector.

15. The internal sizing apparatus as in claim 9 wherein the distal end piece is a multi-axis effector, the multi-axis effector measuring the three-dimensional internal dimensions of the shoe.

16. The internal sizing apparatus as in claim 9 wherein the proximal end piece is shaped to match the contour of an arch of a shoe.

17. An internal shoe sizing apparatus comprising:

a proximal end piece, an actuator connected to the proximal end piece, a probe removably connected to the actuator, the probe comprising a quick release joint piece, a stick length joint piece and a distal end piece connected to the stick length joint piece by a shaft, the stick length joint piece removably connected to the quick release joint piece by a pin, a mount plate positioned over the actuator, and a measurement device for measuring the linear displacement of the probe and thus determining the internal length of a shoe, the measuring device mounted onto the mount plate, in substantially parallel relation to the actuator and connected to the probe.

18. The internal sizing apparatus as in claim 17 wherein the actuator is connected to the quick release joint piece.

19. The internal sizing apparatus as in claim 17 wherein the distal end piece is a solid rectangular shaped effector.

20. The internal sizing apparatus as in claim 17 wherein the distal end piece is a two-piece effector.

21. The internal sizing apparatus as in claim 17 wherein the distal end piece is a multi-axis effector, the multi-axis effector measuring the three-dimensional internal dimensions of the shoe.

22. The internal sizing apparatus as in claim 17 wherein the proximal end piece is shaped to match the contour of an arch of a shoe.

23. A method of quantifying the internal dimensions of a shoe, comprising the steps of:

providing a shoe having an internal heel portion and an internal toe portion, providing an internal sizing apparatus which further comprises a proximal end piece, an actuator mounted to the proximal end piece, a probe connected to the actuator, and a measurement device mounted adjacent to and in substantially parallel relation to the actuator, the measurement device connected to the probe, placing the internal sizing apparatus into the shoe with the proximal end piece of the sizing apparatus abutting the internal heel portion of the shoe, extending the probe toward the internal toe portion of the shoe, measuring the distance the probe extends in the shoe.

24. The method of claim 23 wherein the probe extends to and contacts the toe portion of the shoe.

25. The method of claim 23 wherein the probe further comprises a quick release joint piece, a stick length joint piece and a distal end piece connected to the stick length joint piece by a shaft, the stick length joint piece connected to the quick release joint piece by a pin.

26. The method of claim 25 wherein the distal end piece is a solid rectangular shaped effector.

27. The method of claim 25 wherein the distal end piece is a two-piece effector.

28. The method of claim 25 wherein the distal end piece is a multi-axis effector, the multi-axis effector measuring the three-dimensional internal dimensions of the shoe.

29. The method of claim 25 wherein the actuator and the measurement device are connected to the quick release joint piece.

30. The method of claim 23 further comprising the steps of retracting the probe toward the heel portion of the shoe, and measuring the distance the probe retracts in the shoe.

31. The method of claim 23 wherein the step of measuring the distance the probe extends in the shoe is accomplished by the measurement device.

32. The method of claim 31 wherein the measurement device is a potentiometer.

33. The method of claim 23 wherein the proximal end is shaped to match the contour of an arch of the shoe.

34. An internal shoe sizing apparatus comprising:

a proximal end piece, an actuator mounted to the proximal end piece, a probe connected to the actuator, and an electronic measurement device for measuring the linear displacement of the probe and thus determining the internal length of a shoe, the measuring device mounted adjacent to and in substantially parallel relation to the actuator and connected to the probe.

* * * * *